US012421967B2

(12) United States Patent
Sotojima et al.

(10) Patent No.: US 12,421,967 B2
(45) Date of Patent: Sep. 23, 2025

(54) ROTARY COMPRESSOR AND REFRIGERATION DEVICE

(71) Applicant: DAIKIN INDUSTRIES, LTD., Osaka (JP)

(72) Inventors: Takazo Sotojima, Osaka (JP); Tatsuya Katayama, Osaka (JP); Hiromichi Ueno, Osaka (JP); Arisa Kira, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/926,363

(22) Filed: Oct. 25, 2024

(65) Prior Publication Data

US 2025/0043784 A1 Feb. 6, 2025

Related U.S. Application Data

(63) Continuation of application No. PCT/JP2023/016719, filed on Apr. 27, 2023.

(30) Foreign Application Priority Data

Apr. 27, 2022 (JP) ..... 2022-073745

(51) Int. Cl.
*F04C 18/38* (2006.01)
*F25B 31/02* (2006.01)

(52) U.S. Cl.
CPC ..... *F04C 18/38* (2013.01); *F25B 31/026* (2013.01)

(58) Field of Classification Search
CPC ..... F04C 18/38; F04C 18/32; F04C 18/344; F04C 18/356; F04C 29/12; F25B 31/026
See application file for complete search history.

(56) References Cited

U.S. PATENT DOCUMENTS

| | | | | |
|---|---|---|---|---|
| 3,568,712 | A * | 3/1971 | Rinehart | F04C 29/128 137/855 |
| 11,913,456 | B2 * | 2/2024 | Lee | F04C 29/12 |
| 2002/0085937 | A1 * | 7/2002 | Gennami | F04C 23/008 418/55.4 |
| 2024/0052839 | A1 * | 2/2024 | Lee | F04C 29/128 |

FOREIGN PATENT DOCUMENTS

| | | | |
|---|---|---|---|
| JP | S56-094882 | U | 7/1981 |
| JP | S6024954 | Y2 * | 7/1985 |
| JP | S63183292 | A | 7/1988 |

(Continued)

OTHER PUBLICATIONS

English translation of International Preliminary Report On Patentability (Chapter I) mailed on Nov. 7, 2024, in corresponding PCT/JP2023/016719, 5 pages.

(Continued)

*Primary Examiner* — Jesse S Bogue
(74) *Attorney, Agent, or Firm* — XSENSUS LLP

(57) ABSTRACT

A cylinder end plate of a rotary compressor has a discharge port communicating with a discharge-side space, and the discharge port is formed such that as viewed in the axial direction of a drive shaft, part of an opening of the discharge port overlaps with the inside of a cylinder chamber, and the opening end face of the discharge port is inclined radially outward of the cylinder end plate.

11 Claims, 9 Drawing Sheets

(56) References Cited

FOREIGN PATENT DOCUMENTS

| | | | | |
|---|---|---|---|---|
| JP | H06307362 | A | * | 11/1994 |
| JP | 09250461 | A | * | 9/1997 |
| JP | H11-132178 | A | | 5/1999 |
| JP | 2019027372 | A | | 2/2019 |
| WO | 2021214913 | A1 | | 10/2021 |

OTHER PUBLICATIONS

International Search Report and Written Opinion mailed on Jul. 4, 2023, received for International Application No. PCT/JP2023/016719, filed on Apr. 27, 2023, 08 pages including English Translation.

Extended European Search Report issued Jun. 30, 2025 in corresponding European Patent Application No. 23796503.3 (8 pages).

* cited by examiner

ROTARY COMPRESSOR AND REFRIGERATION DEVICE

CROSS-REFERENCE TO RELATED APPLICATIONS

The present application is a continuation of PCT Application No. PCT/JP2023/016719, filed on Apr. 27, 2023, which claims priority from Japanese Patent Application No. 2022-073745 filed on Apr. 27, 2022, with the Japan Patent Office, and the entire disclosures of these applications are incorporated herein by reference.

TECHNICAL FIELD

The present disclosure relates to a rotary compressor and a refrigeration apparatus.

BACKGROUND ART

Conventionally, in a rotary compressor, refrigerant is compressed in a cylinder chamber formed by a cylinder and cylinder end plates closing the upper and lower ends of the cylinder (for example, Patent Document 1). The compressed refrigerant is discharged to a high-pressure space in a casing through a port penetrating the cylinder end plate.

CITATION LIST

Patent Document

Patent Document 1: Japanese Unexamined Patent Publication No. H11-132178

SUMMARY

Technical Problem

A first aspect of the present disclosure is directed to a rotary compressor including a cylinder (34, 34*a*, 34*b*) having a cylinder chamber (S, S1, S2) therein, a piston (35, 35*a*, 35*b*) configured to eccentrically rotate in the cylinder chamber(S), a drive shaft (70) configured to drive the piston (35, 35*a*, 35*b*), a blade (37) dividing the cylinder chamber (S, S1, S2) into a suction-side space (51) and a discharge-side space (52), and a cylinder end plate (25, 41) closing an end portion of the cylinder (34, 34*a*, 34*b*) in the axial direction thereof, a discharge port (24, 29) communicating with the discharge-side space (52) is formed in the cylinder end plate (25, 41), and the discharge port (24, 29) is formed such that as viewed in the axial direction of the drive shaft (70), part of an opening (24*a*, 29*a*) of the discharge port (24, 29) overlaps with the inside of the cylinder chamber (S, S1, S2), and the opening end face of the discharge port (24, 29) is inclined radially outward of the cylinder end plate (25, 41).

DESCRIPTION OF EMBODIMENTS

Embodiments of the present invention will be described in detail below with reference to the drawings. The following embodiments are merely exemplary ones in nature, and are not intended to limit the scope, applications, or use of the present invention. Features of the embodiments, variations, and other examples described below can be combined or partially substituted within the range where the present invention can be embodied. Terms "upper" and "lower" refer to directions when a rotary compressor (1) is viewed from the front (see FIG. 2). Some drawings may be illustrated without hatching for the sake of ease of understanding of the description.

(1) Refrigeration Apparatus

Figure 1:
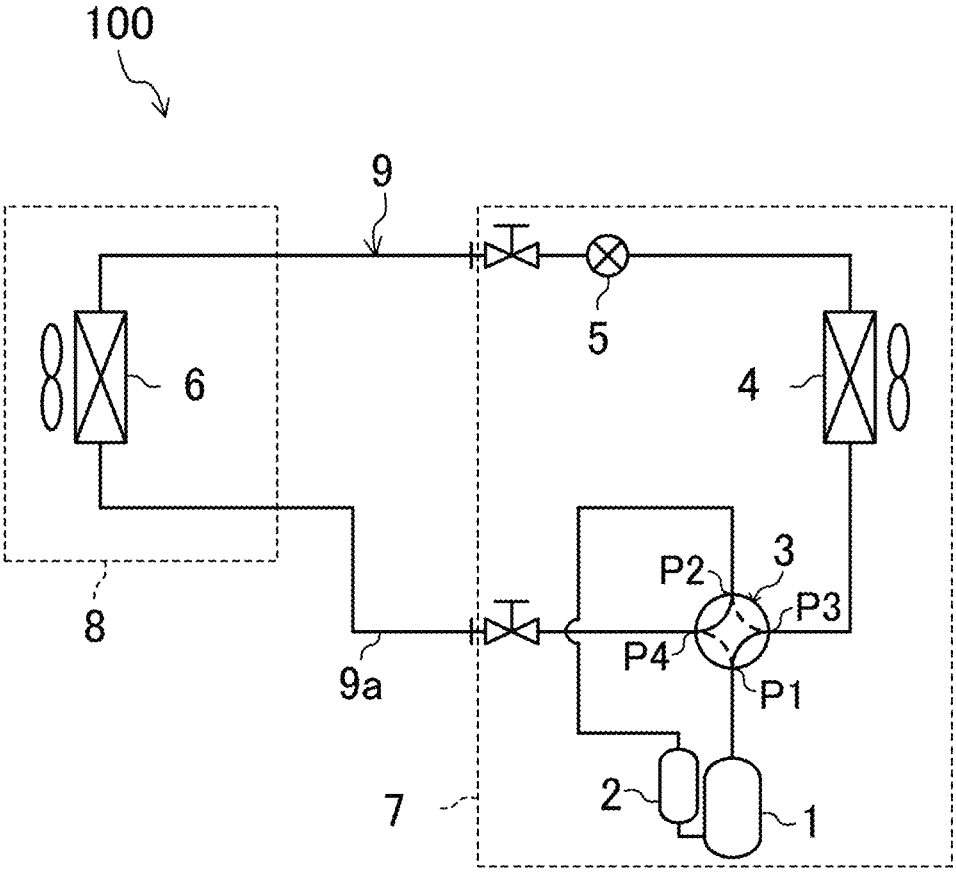
FIG. 1 is a piping system diagram of a refrigeration apparatus according to an embodiment.

As illustrated in FIG. 1, the rotary compressor (1) of this embodiment is applied to a refrigeration apparatus (100). Hereinafter, the rotary compressor (1) may be simply referred to as a compressor (1). The refrigeration apparatus (100) is an air conditioner for conditioning air in an indoor space, for example. The refrigeration apparatus (100) has an outdoor unit (7) disposed in an outdoor space and an indoor unit (8) disposed in the indoor space. The outdoor unit (7) includes the compressor (1), an accumulator (2), a four-way switching valve (3), an outdoor heat exchanger (4), and an expansion valve (5). The indoor unit (8) includes an indoor heat exchanger (6).

The refrigeration apparatus (100) includes a refrigerant circuit (9). The compressor (1), the four-way switching valve (3), the outdoor heat exchanger (4), the expansion valve (5), and the indoor heat exchanger (6) are connected to the refrigerant circuit (9). In the refrigerant circuit (9), refrigerant circulates to perform a refrigeration cycle.

The refrigeration apparatus (100) performs a heating operation and a cooling operation by switching the four-way switching valve (3). In the cooling operation, a first refrigeration cycle is performed. Specifically, when a first port (P1) and a third port (P3) of the four-way switching valve (3) communicate with each other, and a second port (P2) and a fourth port (P4) communicate with each other (solid lines in FIG. 1), the indoor heat exchanger (6) functions as an evaporator, and the outdoor heat exchanger (4) functions as a radiator. In the heating operation, a second refrigeration cycle is performed. Specifically, when the first port (P1) and the fourth port (P4) of the four-way switching valve (3) communicate with each other, and the second port (P2) and the third port (P3) communicate with each other (dashed lines in FIG. 1), the indoor heat exchanger (6) functions as a radiator, and the outdoor heat exchanger (4) functions as an evaporator.

(2) Rotary Compressor

Figure 2:
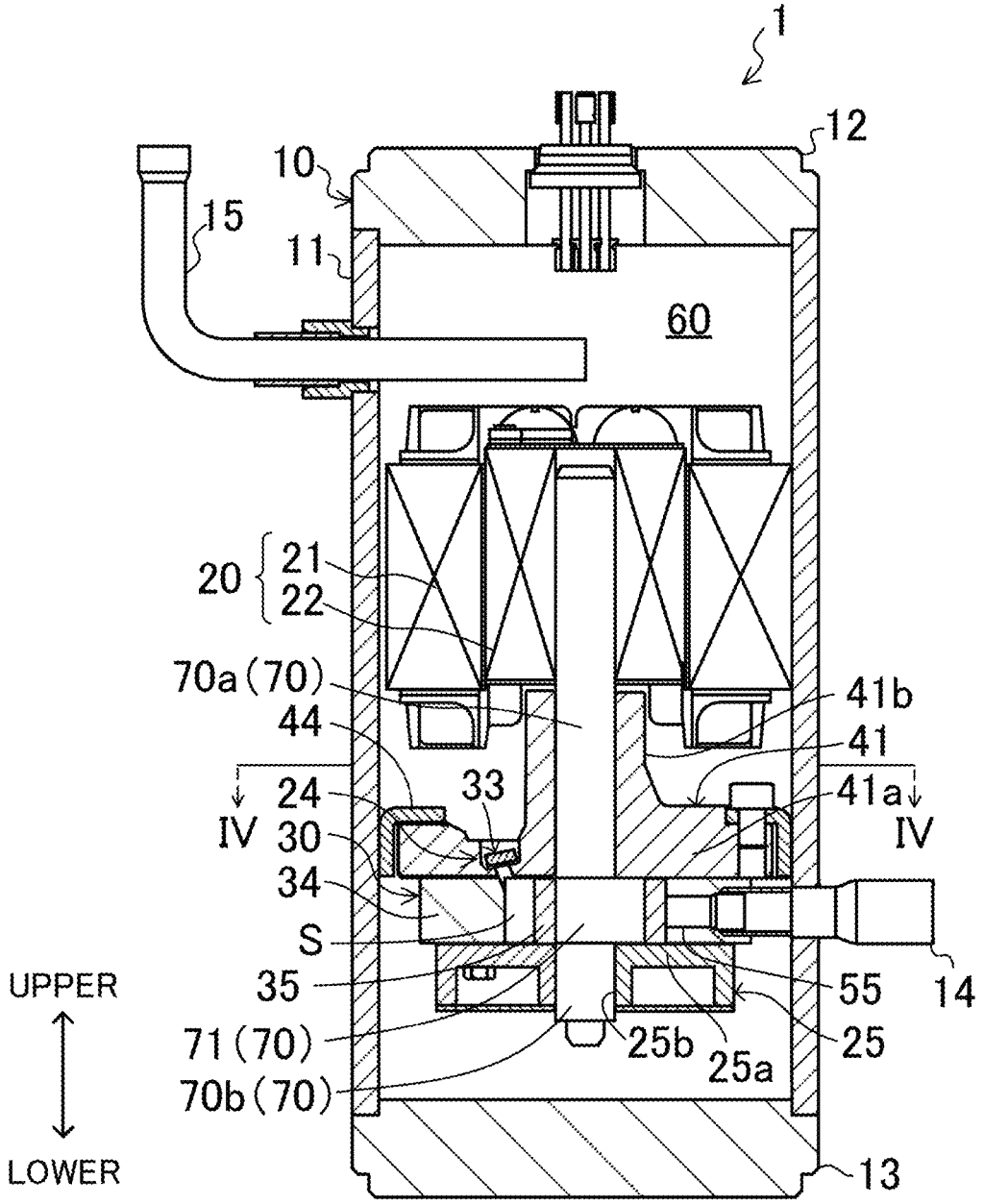
FIG. 2 is a longitudinal sectional view of a rotary compressor according to the embodiment.

As illustrated in FIG. 2, the rotary compressor (1) includes a closed container (10), an electric motor (20), and a compression mechanism (30). The electric motor (20) and the compression mechanism (30) are housed in the closed container (10). The rotary compressor (1) is of a so-called high-pressure dome type where the refrigerant compressed in the compression mechanism (30) is discharged into an internal space (60) of the closed container (10) so that the pressure in the internal space (60) becomes high.

(2-1) Closed Container

The closed container (10) is vertically long. Specifically, the closed container (10) includes a cylindrical barrel (11) extending in an up-down direction, an upper end plate (12) closing the upper end of the barrel (11), and a lower end plate (13) closing the lower end of the barrel (11). The upper end plate (12) and the lower end plate (13) are relatively thick. The barrel (11) has, at its lower portion, a suction pipe (14).

(2-2) Electric Motor

The electric motor (20) is housed in the closed container (10). The electric motor (20) drives the compression mechanism (30). The electric motor (20) is disposed above a mounting plate (44). The electric motor (20) has a tubular stator (21) along the inner peripheral surface of the barrel (11), and a rotor (22) disposed inside the stator (21).

(2-3) Drive Shaft

A drive shaft (70) extends in the up-down direction in the closed container (10). The drive shaft (70) is driven by the electric motor (20). An upper portion of the drive shaft (70) is coupled to the rotor (22) of the electric motor (20).

The drive shaft (70) has, in its lower portion, an upper shaft portion (70*a*), an eccentric portion (71), and a lower shaft portion (70*b*) in this order from top to bottom. The eccentric portion (71) is eccentric with respect to the center axis of the drive shaft (70). The eccentric portion (71) has a diameter larger than those of the upper shaft portion (70*a*) and the lower shaft portion (70*b*).

(2-4) Compression Mechanism

Figure 3:
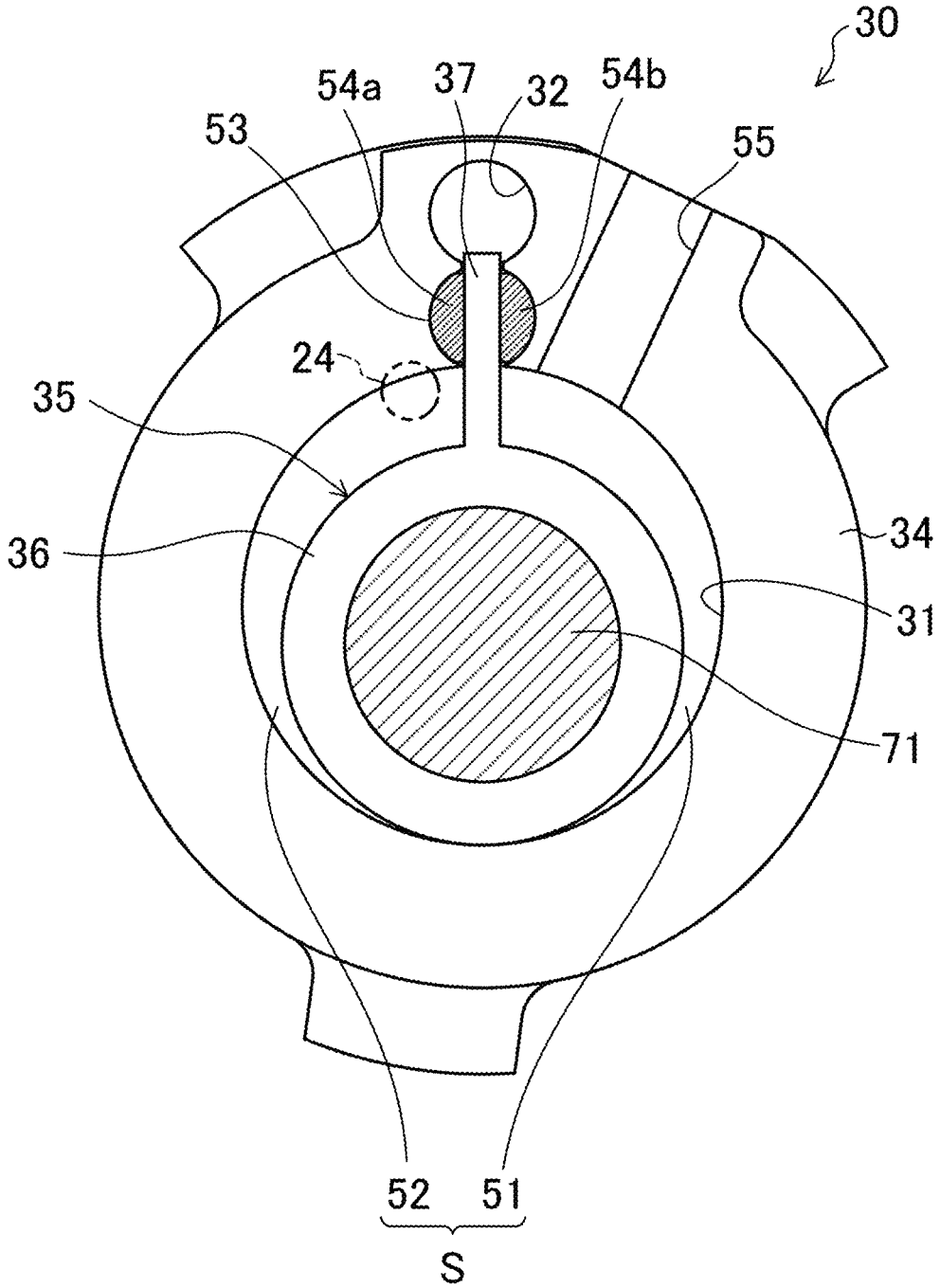
FIG. 3 is a transverse sectional view of a compression mechanism of the rotary compressor.
Figure 4:
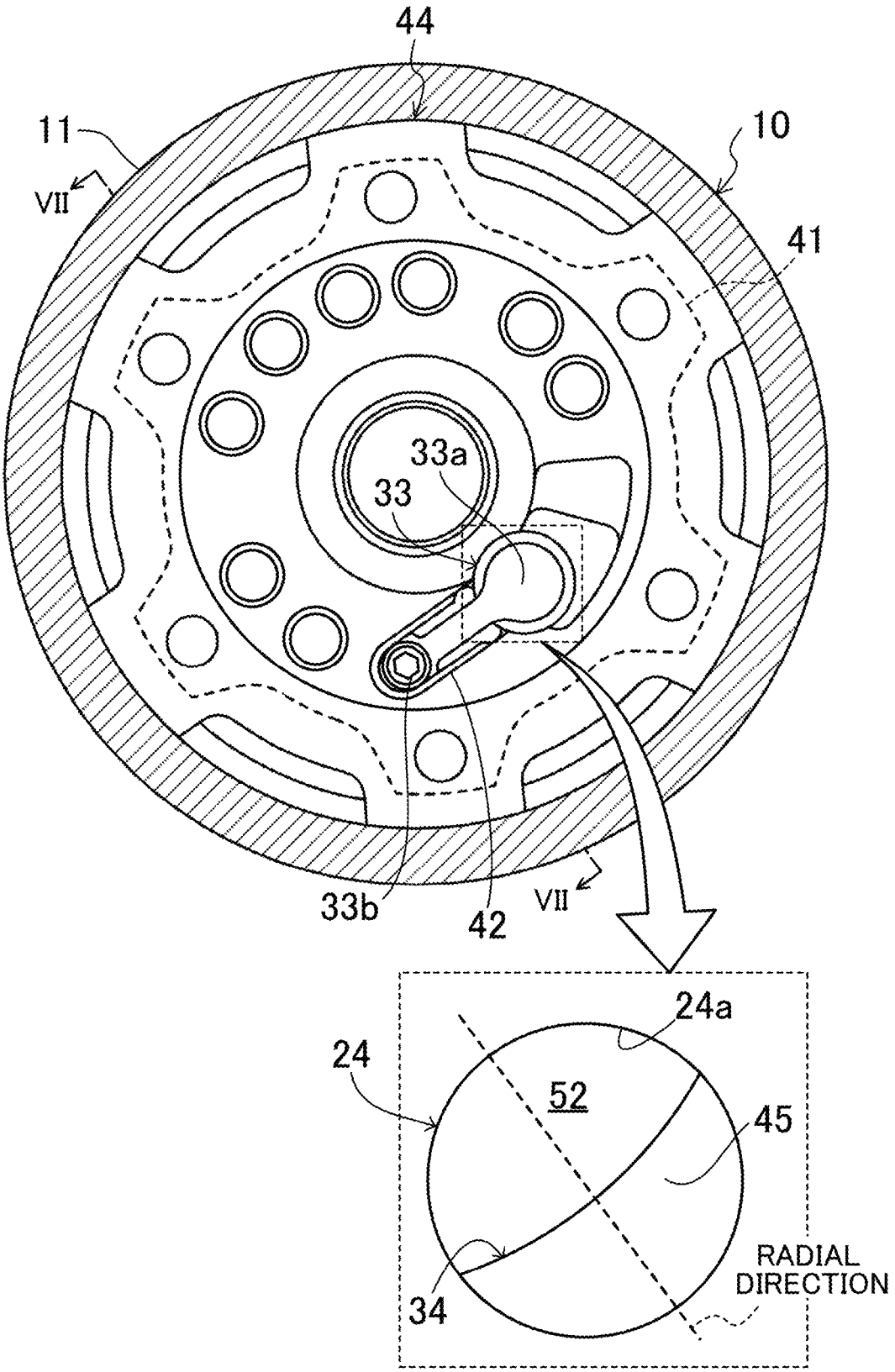
FIG. 4 is a sectional view taken along line IV-IV of FIG. 2.

As illustrated in FIGS. 2 to 4, the compression mechanism (30) is housed in the closed container (10). The compression mechanism (30) compresses the sucked refrigerant, and discharges the compressed refrigerant to the internal space (60) of the closed container (10). The compression mechanism (30) is fixed to the mounting plate (44) fixed to the inner peripheral surface of the barrel (11). Specifically, the compression mechanism (30) is disposed on the lower surface of the mounting plate (44). The compression mechanism (30) includes the drive shaft (70), a cylinder (34), a front head (41), a rear head (25), and a piston (35).

(2-4-1) Cylinder

The cylinder (34) is a thick disk-shaped member. A cylinder bore (31), a blade housing hole (32), and a suction port (55) are formed in the cylinder (34).

The cylinder bore (31) is a circular hole penetrating the cylinder (34) in the thickness direction thereof. The cylinder bore (31) is formed in a center portion of the cylinder (34). The piston (35) is housed in the cylinder bore (31).

The cylinder (34) has a cylinder chamber(S) therein. Specifically, the cylinder chamber(S) is formed between the wall surface of the cylinder bore (31) and the piston (35).

The blade housing hole (32) is a hole extending from the inner peripheral surface of the cylinder (34) (i.e., the outer edge of the cylinder bore (31)) toward the outside of the cylinder (34) in the radial direction. The blade housing hole (32) penetrates the cylinder (34) in the thickness direction thereof. A blade (37) is housed in the blade housing hole (32).

(2-4-2) Front Head

The front head (41) closes the end portion of the cylinder (34) in the axial direction thereof. Specifically, the front head (41) closes the axial end portion (upper end surface of the cylinder (34) in FIG. 1) of the cylinder (34) on the electric motor (20) side. The front head (41) is one example of a cylinder end plate (41) of the present disclosure. The front head (41) includes a first body portion (41*a*) and an upper bearing portion (41*b*). The first body portion (41*a*) and the upper bearing portion (41*b*) are integrally formed.

The first body portion (41*a*) is formed in a substantially circular thick plate shape. The lower surface of the first body portion (41*a*) is in close contact with the upper end surface of the cylinder (34). The upper bearing portion (41*b*) is formed in a cylindrical shape extending from the first body portion (41*a*) toward the electric motor (20) (upward in FIG. 1). The upper bearing portion (41*b*) is located in a center portion of the first body portion (41*a*). The upper bearing portion (41*b*) rotatably supports the upper shaft portion (70*a*) of the drive shaft (70).

A discharge port (24) is formed in the front head (41). The discharge port (24) has an opening (24*a*) and a discharge flow path (24*b*) (see FIG. 6). The opening (24*a*) is formed in the upper surface of the front head (41). The discharge flow path (24*b*) penetrates the first body portion (41*a*) in the thickness direction thereof from the opening (24*a*). The discharge flow path (24*b*) is one example of a flow path (24*b*) of the present disclosure. Thus, the discharge port (24) communicates with a later-described discharge-side space (52) of the cylinder chamber(S). The discharge port (24) will be described in detail later. In the following description, a term "in the discharge port (24)" substantially means "in the discharge flow path (24*b*)."

The discharge port (24) has a reed valve (33) (see FIGS. 2 and 4). The reed valve (33) closes the opening end face of the opening (24*a*) of the discharge port (24). Specifically, the reed valve (33) has an elongated plate member (33*a*) and a fixture member (33*b*) for fixing the plate member (33*a*) to the upper surface of the front head (41).

The plate member (33*a*) is provided so as to cover the opening end face of the opening (24*a*). The fixture member (33*b*) is disposed at one end of the plate member (33*a*). The reed valve (33) is configured such that when the pressure of the refrigerant in the discharge-side space (52) reaches a predetermined value or more, the plate member (33*a*) moves away from the opening (24*a*) with the fixture member (33*b*) as the point of support and the refrigerant is discharged accordingly.

(2-4-3) Rear Head

The rear head (25) closes the end surface of the cylinder (34) opposite to the electric motor (20) (i.e., the lower end surface of the cylinder (34) in FIG. 1). The rear head (25) includes a second body portion (25*a*) and a lower bearing portion (25*b*).

The second body portion (25*a*) is formed in a substantially circular thick plate shape. The upper surface of the second body portion (25*a*) is in close contact with the lower end surface of the cylinder (34). The lower bearing portion (25*b*) is formed in a cylindrical shape extending from the second body portion (25*a*) toward the side opposite to the cylinder (34) (downward in FIG. 2). The lower bearing portion (25*b*) is located in a center portion of the second body portion (25*a*). The lower bearing portion (25*b*) rotatably supports the lower shaft portion (70*b*) of the drive shaft (70).

(2-4-4) Piston

As illustrated in FIG. 3, the piston (35) is housed in the cylinder (34). The piston (35) eccentrically rotates in the cylinder chamber(S). The piston (35) slides on both the front head (41) and the rear head (25). The piston (35) has a piston body (36) and the blade (37).

The piston body (36) is formed in an annular shape. Specifically, the piston body (36) is formed in a slightly-thick cylindrical shape. The eccentric portion (71) of the drive shaft (70) is slidably inserted into the piston body (36). The piston body (36) is configured such that when the drive shaft (70) rotates, the piston body (36) revolves along the inner peripheral surface of the cylinder (34).

The blade (37) is formed integrally with the piston body (36). The blade (37) protrudes radially outward from the outer peripheral surface of the piston body (36). The blade (37) is fitted in the blade housing hole (32). The blade (37) is sandwiched between a pair of swing bushes (54*a*, 54*b*) provided in a bush groove (53) extending radially outward from the inner peripheral surface of the cylinder (34). The blade (37) restricts rotation of the piston body (36) when the piston body (36) revolves. The blade (37) divides the cylinder chamber(S) into a suction-side space (51) and the discharge-side space (52).

(3) Operation

Figure 5:
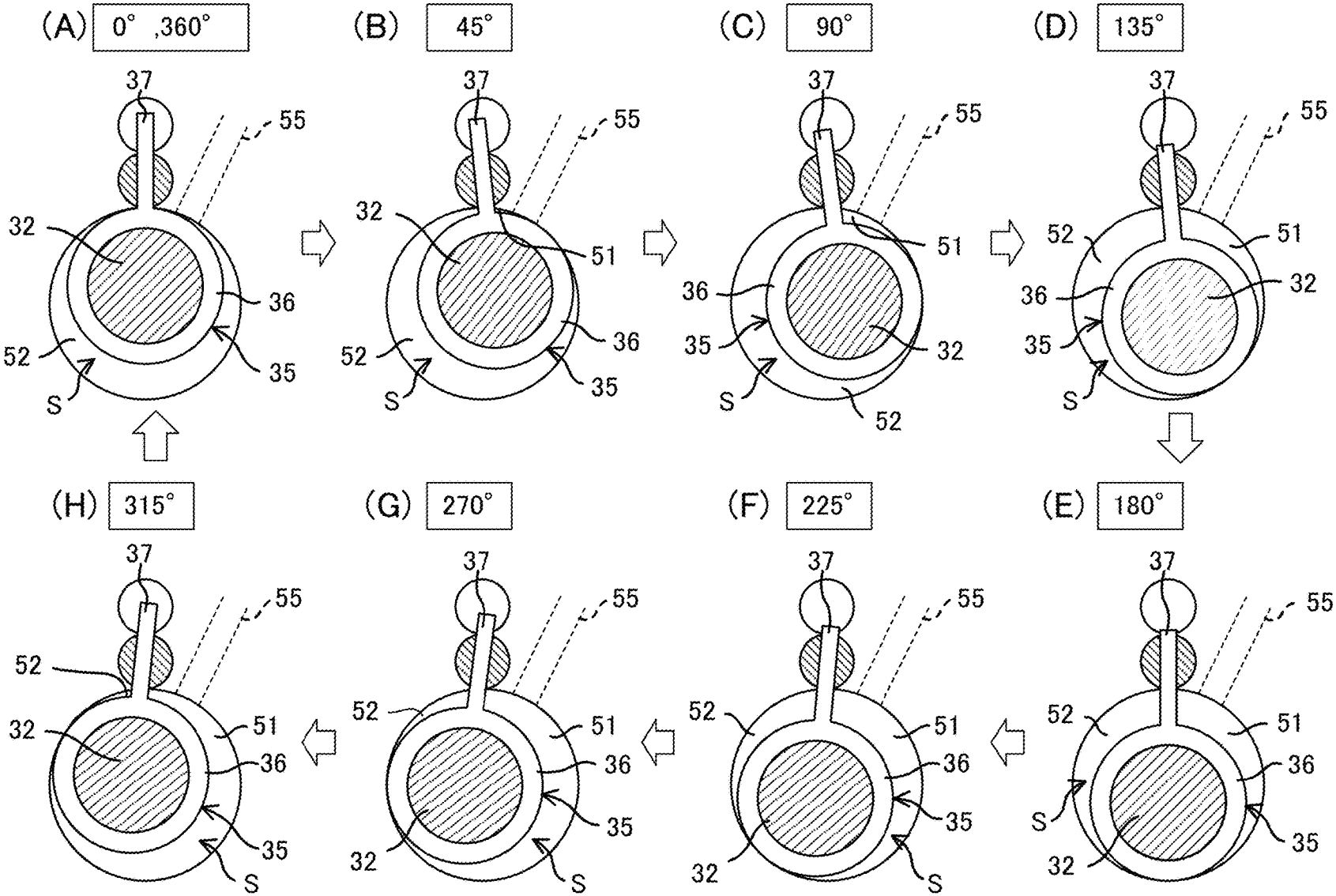
FIG. 5 shows views of operation of the compression mechanism.

As illustrated in FIG. 5, in the compressor (1), when the electric motor (20) is started to rotate the rotor (22), the drive shaft (70) rotates and the eccentric portion (71) rotates eccentrically. As the eccentric portion (71) rotates eccentrically, the piston (35) revolves along the inner peripheral surface of the cylinder (34) while restricting its rotation.

A suction phase of sucking the refrigerant into the cylinder chamber(S) will be described. When the drive shaft (70) slightly rotates from a state (state of (A) in FIG. 5) of a rotational angle of 0°, the position of contact between the piston (35) and the cylinder (34) passes by the inner peripheral end of the suction port (55). At this time, suction of the refrigerant into the suction-side space (51) starts.

The refrigerant is sucked from the suction pipe (14) through the suction port (55). As the rotational angle of the drive shaft (70) increases, the volume of the suction-side space (51) gradually increases, and then the amount of refrigerant sucked into the suction-side space (51) increases (states of (B) to (H) in FIG. 5). This refrigerant suction phase continues until the rotational angle of the drive shaft (70) reaches 360°, and then shifts to a discharge phase.

The discharge phase of compressing the refrigerant in the cylinder chamber(S) and discharging the compressed refrigerant therefrom will be described. When the drive shaft (70) slightly rotates from the state (state of (A) in FIG. 5) of a rotational angle of 0°, the position of contact between the piston (35) and the cylinder (34) passes by the inner peripheral end of the suction port (55) again. At this time, confinement of the refrigerant in the suction-side space (51) is completed.

The suction-side space (51) connected to the suction port (55) serves as the discharge-side space (52) connected only to the discharge port (24). From this state, compression of the refrigerant in the discharge-side space (52) starts. As the rotational angle of the drive shaft (70) increases, the volume of the discharge-side space (52) decreases, and then the pressure of the discharge-side space (52) increases. When the pressure of the discharge-side space (52) exceeds a predetermined pressure, the reed valve (33) opens.

At this time, the refrigerant in the discharge-side space (52) is discharged from the discharge port (24), flows into the internal space of the closed container (10), and is then discharged to the outside of the compressor (1) through the discharge pipe (15). This refrigerant discharge phase continues until the rotational angle of the drive shaft (70) reaches 360°, and then shifts to a suction phase. In this manner, the compressor (1) continuously performs the refrigerant compression operation by alternately repeating the suction phase and the discharge phase in the cylinder chamber(S).

(4) Problem of Re-Expansion Volume in Discharge Port

The refrigerant compressed in the discharge-side space (52) is discharged to the outside of the cylinder chamber(S) through the discharge port (24) by opening the reed valve (33), but part of the compressed refrigerant is not discharged to the cylinder chamber(S) and remains in the discharge port (24).

Specifically, in the discharge phase, when the rotational angle of the drive shaft (70) reaches 360°, the volume of the discharge-side space (52) becomes substantially zero, and the refrigerant compressed in the discharge-side space (52) is entirely pushed out. However, the refrigerant remaining in the discharge port (24) is not discharged to the outside of the discharge port (24) and stays therein. Thereafter, the reed valve (33) is closed and rotation of the drive shaft (70) continues, whereby the refrigerant in the discharge port (24) flows into the cylinder chamber(S) again and is expanded again. When the amount of refrigerant gas re-expanded as described above increases, the amount of refrigerant newly compressed in the discharge-side space (52) decreases, resulting in a decrease in compression efficiency.

In contrast, if the volume of the discharge flow path (24*b*) is decreased, the amount of refrigerant gas to be re-expanded can be decreased. For example, if the thickness of the front head (41) is decreased, the length of the discharge flow path (24*b*) is shortened accordingly, and the volume of the discharge flow path (24*b*) can be decreased. However, if the thickness of the front head (41) is decreased, the lower surface of the front head (41) may be deformed so as to bulge inward of the cylinder chamber(S) due to a pressure difference between the inside and outside of the cylinder chamber(S), and the piston (35) may come into contact with the lower surface of the front head (41).

Further, by narrowing the discharge flow path (24*b*), the volume of the discharge flow path (24*b*) can be decreased. However, when the discharge flow path (24*b*) is narrowed, the flow rate of refrigerant to be discharged is decreased, which may cause a decrease in compression efficiency.

In view of such a problem, in the rotary compressor (1) of the present disclosure, the discharge port (24) and the reed valve (33) are configured to reduce deformation of the front head (41) and suppress the decrease in compression efficiency. The discharge port (24) and the reed valve (33) of this embodiment will be described in detail below.

(5-1) Discharge Port

As illustrated in the enlarged view of FIG. 4, the opening end face of the opening (24*a*) of the discharge port (24) is formed in a circular shape. The discharge port (24) is located closer to the outer periphery of the front head (41). Specifically, when the front head (41) is viewed from above, a radially outer portion of the opening end face of the opening (24*a*) overlaps with the cylinder (34), and a radially inner portion overlaps with the cylinder chamber(S). In this manner, the discharge port (24) is formed such that part of the opening (24*a*) overlaps with the cylinder chamber(S) when viewed in the axial direction of the drive shaft (70).

Figure 6:
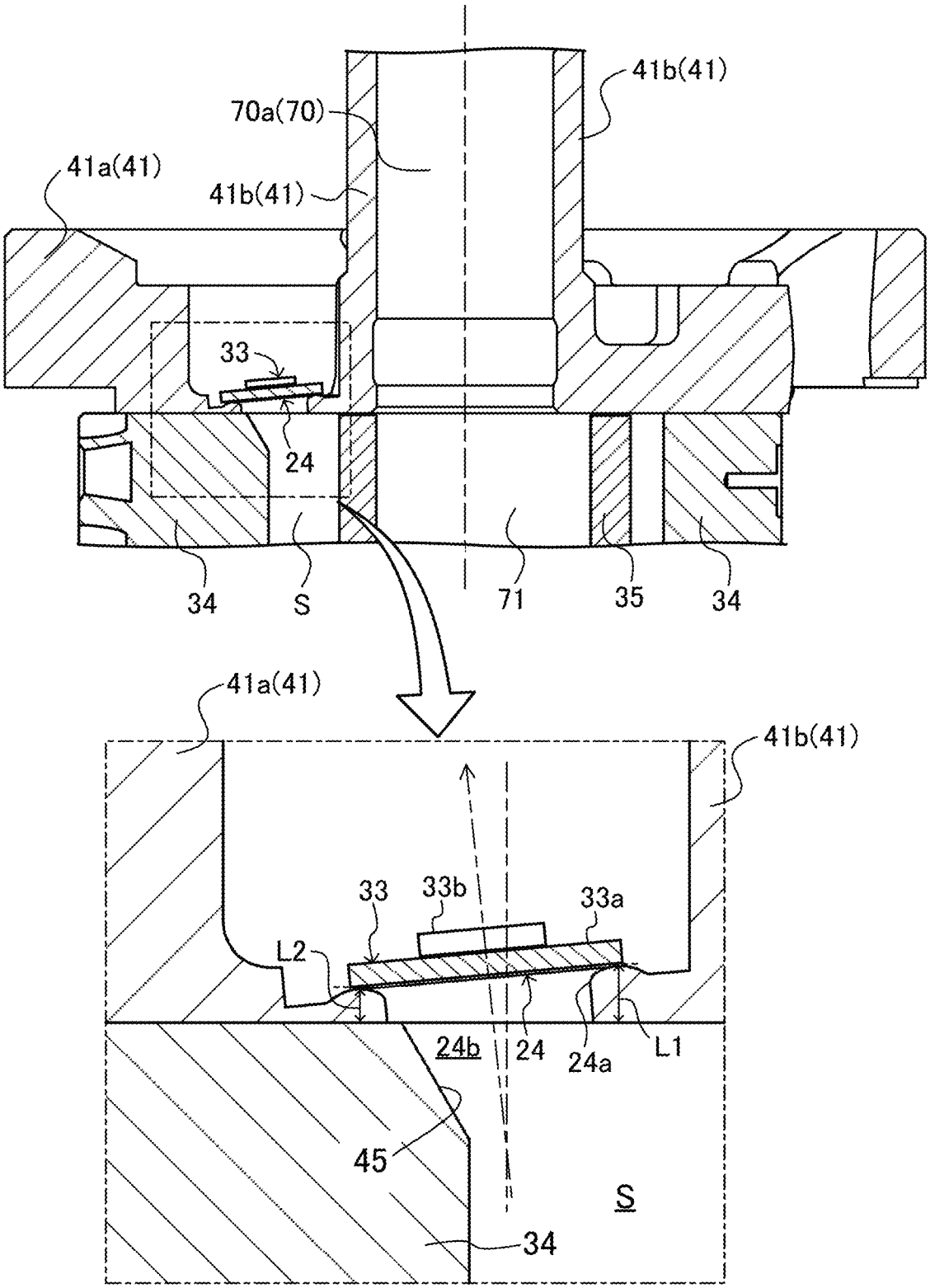
FIG. 6 is a partially-enlarged longitudinal sectional view of the rotary compressor.

As illustrated in FIG. 6, the opening end face of the opening (24*a*) of the discharge port (24) is inclined so as to face radially outward of the front head (41). Specifically, in the longitudinal section of the front head (41) (see the enlarged view of FIG. 6), a length L1 from the lower surface of the front head (41) to the radially inner upper end of the opening (24*a*) is longer than a length L2 from the lower surface of the front head (41) to the radially outer upper end of the opening (24*a*). Thus, the first body portion (41*a*) of the front head (41) is formed to be thicker on the inner side than on the outer side with respect to the discharge port (24) in the radial direction.

The discharge flow path (24*b*) of the discharge port (24) has a circular section orthogonal to its flow path direction. The discharge flow path (24*b*) is inclined with respect to the axial direction of the drive shaft (70) such that a first direction (see an arrow indicated by a dashed-dotted line in FIG. 6), which is a direction from the discharge-side space (52) side toward the opening (24*a*), is directed radially outward of the front head (41) with respect to the drive shaft (70).

The discharge flow path (24*b*) is formed such that part of the inner peripheral surface of the cylinder (34) is hollowed out from the opening (24*a*) toward the cylinder chamber(S). Specifically, the cylinder (34) has a cutout (45) formed by cutting out part of the inner peripheral surface of the cylinder (34), and the cutout (45) forms part of the discharge flow path (24*b*). The cutout (45) is formed such that the discharge flow path (24*b*) has a constant flow path area (area of the section of the discharge flow path (24*b*) orthogonal to the first direction).

(5-3) Reed Valve

Figure 7:
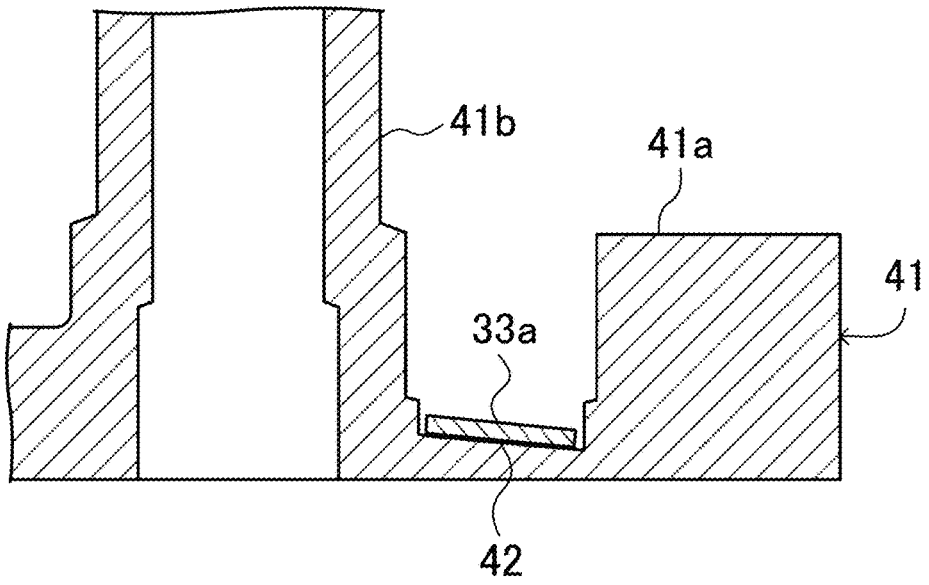
FIG. 7 is a partially-enlarged sectional view taken along line VII-VII of FIG. 4.

As illustrated in FIG. 7, the front head (41) has a mounting surface (42) with which the plate member (33*a*) of the reed valve (33) contacts. The mounting surface (42) is formed on the upper surface of the first body portion (41*a*). The mounting surface (42) extends from the opening (24*a*) in a direction orthogonal to the radial direction of the front head (41).

The mounting surface (42) is formed to be smoothly continuous to the opening end face of the opening (24*a*). Specifically, the mounting surface (42) is inclined in its section at an angle equal to that of the opening end face of the opening (24*a*). Thus, when viewed from the longitudinal direction of the plate member (33*a*), the plate member (33*a*) is provided to be inclined at an angle equal to that of the opening end face of the opening (24*a*). The fixture member (33*b*) is also provided to be inclined at an angle equal to that of the opening end face of the opening (24*a*).

(6) Features (6-1) First Feature

In the rotary compressor (1) of this embodiment, the front head (41) (cylinder end plate) has the discharge port (24) communicating with the discharge-side space (52), and as viewed from the axial direction of the drive shaft (70), part of the opening (24*a*) of the discharge port (24) overlaps with the cylinder chamber(S), and the opening end face of the opening (24*a*) is inclined so as to face radially outward of the front head (41).

According to this embodiment, the opening end face of the discharge port (24) is formed to be inclined, and therefore, the volume in the discharge port (24) can be decreased. As a result, the amount of refrigerant gas which cannot be discharged from the discharge-side space (52) to the internal space (60) and thus remains in the discharge port (24) can be reduced. This can reduce the amount of refrigerant gas re-expanded in the discharge-side space (52); therefore, the decrease in the compression efficiency can be suppressed.

In addition, since the opening end face of the discharge port (24) is inclined so as to face radially outward of the front head (41), the front head (41) can be formed to be thicker on the inside than on the outside in the radial direction with respect to the position at which the discharge port (24) is located. This can reduce deformation of the front head (41) due to the refrigerant gas pressure difference.

(6-2) Second Feature

In the rotary compressor (1) of this embodiment, the discharge port (24) has the discharge flow path (24*b*) causing the discharge-side space (52) and the opening (24*a*) to communicate with each other, and the discharge flow path (24*b*) is formed such that the first direction is inclined radially outward of the front head (41) with respect to the drive shaft (70) when the first direction is the direction from the discharge-side space (52) toward the opening (24*a*).

According to this embodiment, the discharge flow path (24*b*) is inclined so that the front head (41) can be formed to be thicker on the radially inner side than on the radially outer side with respect to the position at which the opening (24*a*) is located. Thus, deformation of the front head (41) and the decrease in the compression efficiency can be easily suppressed simply by inclining the discharge flow path (24*b*).

(6-3) Third Feature

In the rotary compressor (1) of this embodiment, the cutout (45) is formed by cutting out part of the inner peripheral surface of the cylinder (34). The cutout (45) forms part of the inner peripheral surface of the discharge flow path (24*b*).

The cutout (45) allows the discharge flow path (24*b*) to have a sufficient flow path width (area in the section orthogonal to the flow path direction), thereby suppressing a decrease in the flow rate of refrigerant flowing through the discharge flow path (24*b*). This can suppress the decrease in the compression efficiency.

In addition, since the outer periphery of the lower surface of the front head (41) is connected to the upper end surface of the cylinder (34), a portion of the front head (41) closer to the outer periphery thereof has a higher strength against the refrigerant pressure than those of other portions. Since the opening (24*a*) is located such that part of the opening end face thereof overlaps with the cylindrical wall of the cylinder (34), the influence of the refrigerant pressure is reduced even if the radially outer portion of the front head (41) with respect to the opening (24*a*) is relatively thin. The discharge port (24) is provided such that part of the opening end face of the opening (24*a*) overlaps with the cylindrical wall of the cylinder (34) so that the strength of the front head (41) can be ensured.

Figure 8:
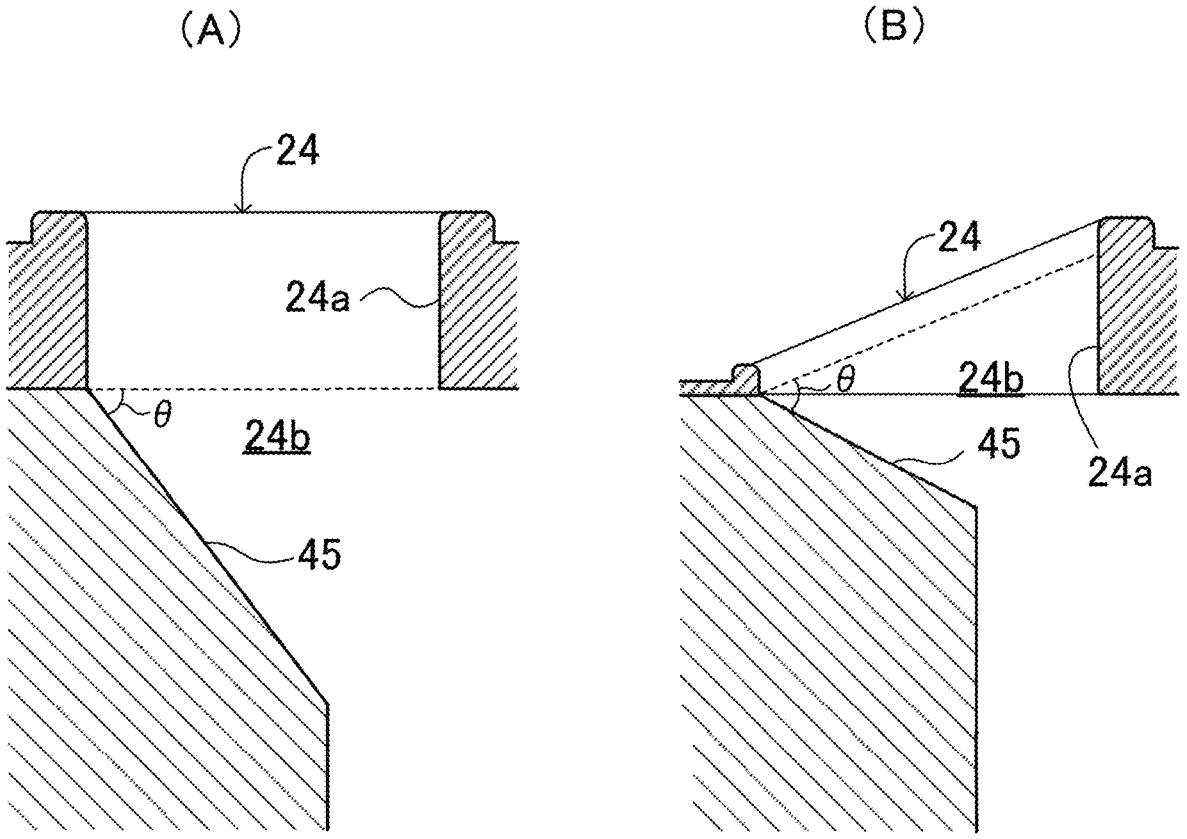
FIG. 8 shows views for describing the features and effects of the rotary compressor according to the embodiment.

In addition, the discharge port (24) is formed such that the opening end face of the opening (24*a*) is inclined and the discharge flow path (24*b*) is inclined. This can reduce the amount of refrigerant gas remaining in the discharge flow path (24*b*). Specifically, as illustrated in FIG. 8, when the angle of the flow path direction of the discharge flow path (24*b*) with respect to the opening end face of the opening (24*a*) is 0, the flow path length of the discharge flow path (24*b*) can be shortened in a case where the discharge flow path (24*b*) is provided with the opening end face of the opening (24*a*) inclined (FIG. 8(B)) than in a case where the discharge flow path (24*b*) is provided without the opening end face of the opening (24*a*) inclined ((A) in FIG. 8). In other words, the former case can decrease the volume of the discharge flow path (24*b*); therefore, the amount of refrigerant gas remaining in the discharge flow path (24*b*) can be reduced.

(6-4) Fourth Feature

The rotary compressor (1) of this embodiment further includes the reed valve (33) that closes the opening (24*a*) and the fixture member (33*b*) that fixes the reed valve (33) to the front head (41), and the fixture member (33*b*) is provided to be inclined at an angle equal to that of the opening end face of the opening (24*a*).

If the plate member (33*a*) is provided without being inclined at an angle equal to that of the opening end face of the opening (24*a*), the plate member (33*a*) is twisted because the opening end face of the opening (24*a*) is inclined, and a gap is formed between the opening (24*a*) and the plate member (33*a*), which may cause leakage of the refrigerant gas. However, according to this embodiment, the plate member (33*a*) of the reed valve (33) is fixed to be inclined at an angle equal to that of the opening end face of the opening (24*a*); therefore, the opening (24*a*) can be sealed without any gap. As a result, the leakage of the refrigerant gas can be reduced.

(7) Variations

A rotary compressor (1) of a variation has a two-cylinder compression mechanism (30). The compression mechanism (30) of this example has a first discharge port (24) provided in the front head (41) and a second discharge port (29) provided in the rear head (25). A configuration different from that of the above-described embodiment will be described below.

Figure 9:
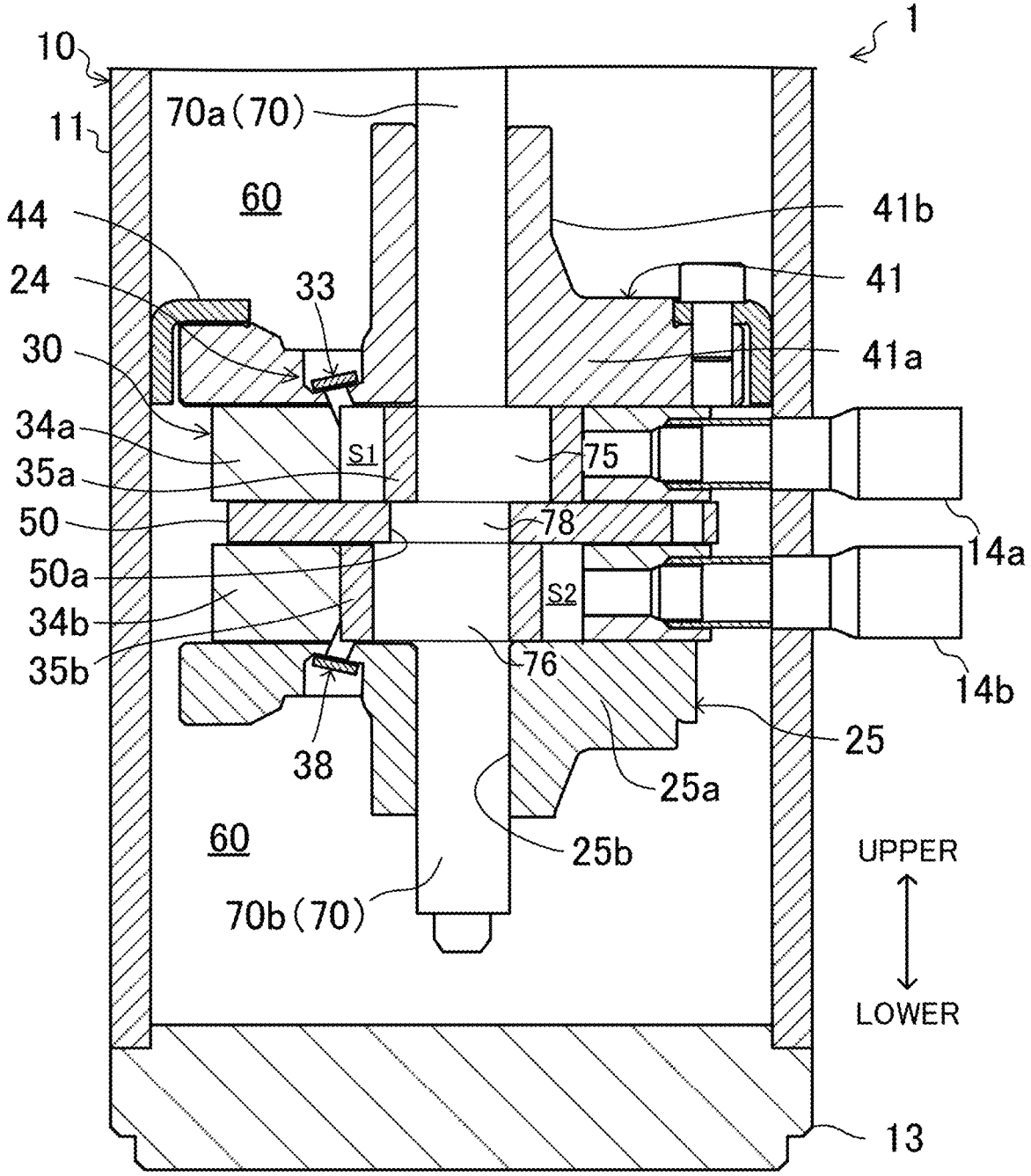
FIG. 9 is a longitudinal sectional view of a rotary compressor according to a variation.

As illustrated in FIG. 9, in the compression mechanism (30) of this example, the front head (41), a first cylinder (34*a*), an intermediate plate (50), a second cylinder (34*b*), and the rear head (25) are arranged in this order from the top.

The first cylinder (34*a*) and the second cylinder (34*b*) are one example of a cylinder (34*a*, 34*b*) of the present disclosure. The first cylinder (34*a*) and the second cylinder (34*b*) have the same shape as that of the cylinder (34) of the above-described embodiment, and therefore, description thereof is omitted.

The first discharge port (24) of the front head (41) is provided with a first reed valve (33). The first discharge port (24) and the first reed valve (33) have the same configurations as those of the discharge port (24) and the reed valve (33) of the above-described embodiment, and therefore, description thereof is omitted.

The intermediate plate (50) is sandwiched between the first cylinder (34*a*) and the second cylinder (34*b*). The intermediate plate (50) is in close contact with the lower end surface of the first cylinder (34*a*) and the upper end surface of the second cylinder (34*b*).

A center hole (50*a*) penetrating the intermediate plate (50) in the thickness direction thereof is formed in a center portion of the intermediate plate (50). A later-described intermediate coupling portion (78) of the drive shaft (70) is inserted into the center hole (50*a*) of the intermediate plate (50).

The drive shaft (70) of this example includes the upper shaft portion (70*a*), a first eccentric portion (75), the intermediate coupling portion (78), a second eccentric portion (76), and the lower shaft portion (70*b*). In the drive shaft (70), the upper shaft portion (70*a*), the first eccentric portion (75), the intermediate coupling portion (78), the second eccentric portion (76), and the lower shaft portion (70*b*) are located in this order from the top to the bottom. The upper shaft portion (70*a*), the first eccentric portion (75), the intermediate coupling portion (78), the second eccentric portion (76), and the lower shaft portion (70*b*) are integrally formed.

Each eccentric portion (75, 76) is a circular columnar portion having a larger radius than that of the upper shaft portion (70*a*). The center axis of each eccentric portion (75, 76) is eccentric with respect to the rotational center axis of the drive shaft (70). The first eccentric portion (75) is eccentric to the side opposite to the second eccentric portion (76) with respect to the rotational center axis of the drive shaft (70). In other words, the eccentric direction of the first eccentric portion (75) with respect to the rotational center axis of the drive shaft (70) is different from the eccentric direction of the second eccentric portion (76) with respect to the rotational center axis of the drive shaft (70) by 180°.

The intermediate coupling portion (78) is located and couples between the first eccentric portion (75) and the second eccentric portion (76).

The compression mechanism (30) of this example includes a first piston (35*a*) and a second piston (35*b*). The first piston (35*a*) and the second piston (35*b*) are members having the same shape, dimensions, and material. The first piston (35*a*) and the second piston (35*b*) are one example of a piston (35*a*, 35*b*) of the present disclosure.

The first piston (35*a*) is housed in the first cylinder (34*a*). The first eccentric portion (75) of the drive shaft (70) is inserted into the first piston (35*a*). The first piston (35*a*) eccentrically rotates when the first eccentric portion (75) of the drive shaft (70) rotates.

In the first piston (35*a*), the outer peripheral surface slides on the inner peripheral surface of the first cylinder (34*a*), one end surface (upper surface) slides on the lower surface of the first body portion (41*a*) of the front head (41), and the other end surface (lower surface) slides on the upper surface of the intermediate plate (50). In the compression mechanism (30), a first cylinder chamber (S1) is formed between the outer peripheral surface of the first piston (35*a*) and the inner peripheral surface of the first cylinder (34*a*).

The second piston (35*b*) is housed in the second cylinder (34*b*), and eccentrically rotates. The second eccentric portion (76) of the drive shaft (70) is inserted into the second piston (35*b*). The second piston (35*b*) eccentrically rotates when the second eccentric portion (76) of the drive shaft (70) rotates.

In the second piston (35*b*), the outer peripheral surface slides on the inner peripheral surface of the second cylinder (34*b*), one end surface (lower surface) slides on the upper surface of the second body portion (25*a*) of the rear head (25), and the other end surface (upper surface) slides on the lower surface of the intermediate plate (50). In the compression mechanism (30), a second cylinder chamber (S2) is formed between the outer peripheral surface of the second piston (35*b*) and the inner peripheral surface of the second cylinder (34*b*).

(2-2-3) Rear Head

The rear head (25) closes the end face of the second cylinder (34*b*) opposite to the electric motor (20) (i.e., the lower end surface of the second cylinder (34*b*) in FIG. 9). The rear head (25) of this example is one example of the cylinder end plate (25) of the present disclosure.

Figure 10:
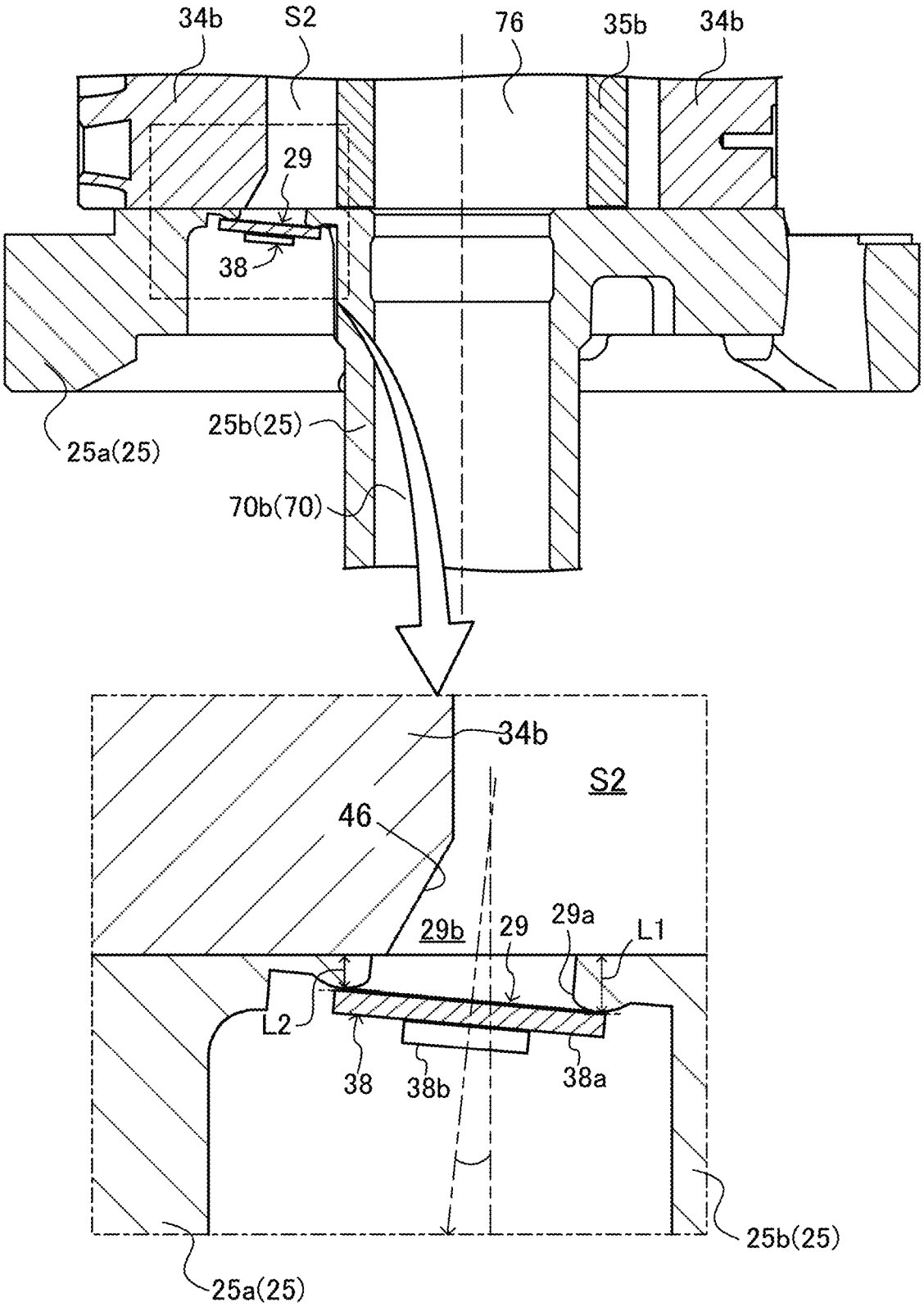
FIG. 10 is a partially-enlarged longitudinal sectional view of the rotary compressor.

As illustrated in FIG. 10, the opening (29*a*) of the second discharge port (29) is formed in the lower surface of the rear head (25). The discharge flow path (29*b*) of the second discharge port (29) penetrates the second body portion (25*a*) of the rear head (25) in the thickness direction thereof from the opening (29*a*). The discharge flow path (29*b*) of the second discharge port (29) is one example of the flow path (29*b*) of the present disclosure. The second discharge port (29) communicates with the discharge-side space (52) in the second cylinder chamber (S2).

The opening end face of the opening (29*a*) of the second discharge port (29) is formed in a circular shape. The second discharge port (29) is located closer to the outer periphery of the rear head (25). Specifically, when the rear head (25) is viewed from below, a radially outer portion of the opening end face of the opening (29*a*) overlaps with the second cylinder (34*b*), and a radially inner portion overlaps with the second cylinder chamber (S2). The second discharge port (29) is formed such that part of the opening (29*a*) overlaps with the second cylinder chamber (S2) when viewed in the axial direction of the drive shaft (70).

The opening end face of the opening (29*a*) of the second discharge port (29) is inclined so as to face radially outward of the rear head (25). Specifically, in the longitudinal section of the rear head (25) (see the enlarged view of FIG. 10), a length L1 from the upper surface of the rear head (25) to the radially inner upper end of the opening (29*a*) of the second discharge port (29) is longer than a length L2 from the upper surface of the rear head (25) to the radially outer upper end of the opening (29*a*) of the second discharge port (29). Thus, the second body portion (25*a*) of the rear head (25) is formed to be thicker on the inner side than on the outer side with respect to the second discharge port (29) in the radial direction.

The discharge flow path (29*b*) of the second discharge port (29) has a circular section orthogonal to its flow path direction. The discharge flow path (29*b*) is formed such that a first direction (see an arrow in FIG. 10) is inclined radially outward of the rear head (25) with respect to the drive shaft (70) when the first direction is a direction from the discharge-side space (52) side of the second cylinder (34*b*) toward the opening (29*a*).

As in the first discharge port (24), the discharge flow path (29*b*) of the second discharge port (29) is formed such that part of the inner peripheral surface of the second cylinder (34*b*) is hollowed out from the opening (29*a*) toward the second cylinder chamber (S2). Specifically, the second cylinder (34*b*) has the cutout (46) formed by cutting out part of the inner peripheral surface of the second cylinder (34*b*), and the cutout (46) forms part of the discharge flow path (29*b*).

A second reed valve (38) provided in the second discharge port (29) of the rear head (25) has the same configuration as that of the first reed valve (33). The second reed valve (38) is disposed on a mounting surface (not illustrated) inclined at an angle equal to that of the opening (29*a*) of the second discharge port (29). Thus, the plate member (38*a*) of the second reed valve (38) is also provided to be inclined at an angle equal to that of the opening end face of the opening (29*a*) of the second discharge port (29). The fixture member (38*b*) of the second reed valve (38) is also provided to be inclined at an angle equal to that of the opening end face of the opening (29*a*).

In this example, the amount of refrigerant gas remaining in the first discharge port (24) and the second discharge port (29) can also be reduced; therefore, the decrease in the compression efficiency of the compression mechanism (30) can be suppressed. Further, since the opening (29*a*) of the second discharge port (29) is formed such that the opening end face thereof is inclined radially outward of the rear head (25) and part of the opening end face is formed closer to the outer periphery of the rear head (25) so as to overlap with the second cylinder chamber (S2), the rear head (25) can be formed relatively thick. As a result, distortion of the rear head due to the refrigerant pressure difference can be reduced.

Other Embodiments

The embodiments and variations described above may also be configured as follows.

The discharge port (24) of the above-described embodiment is only required to be formed such that the opening end face of the opening (24*a*) is inclined radially outward as viewed from above the front head (41), and the discharge flow path (24*b*) is not necessarily inclined. The same also applies to the first discharge port (24) and the second discharge port (29) of the above-described variation.

The cylinder (34) of the above-described embodiment does not necessarily have the cutout (45). In other words, the discharge flow path (24*b*) of the discharge port (24) is not necessarily formed by hollowing out part of the inner surface of the cylinder (34). The same also applies to the above-described variation.

While the embodiments and variations thereof have been described above, it will be understood that various changes in form and details may be made without departing from the spirit and scope of the claims. The embodiments and the variations thereof may be combined and replaced with each other without deteriorating intended functions of the present disclosure. The expressions of "first," "second," . . . described above are used to distinguish the terms to which these expressions are given, and do not limit the number and order of the terms.

INDUSTRIAL APPLICABILITY

As described above, the present disclosure is useful for a rotary compressor and a refrigeration apparatus.

EXPLANATION OF REFERENCES

1 Rotary Compressor
24, 29 Discharge Port
24*a*, 29*a* Opening
24*b*, 29*b* Discharge Flow Path (Flow Path)
25 Rear Head (Cylinder End Plate)
41 Front Head (Cylinder End Plate)
33, 38 Reed Valve
33*b*, 38*b* Fixture Member
34 Cylinder
34*a* First Cylinder (Cylinder)

34*b* Second Cylinder (Cylinder)
35 Piston
35*a* First Piston (Piston)
35*b* Second Piston (Piston)
37 Blade
45, 46 Cutout
51 Suction-Side Space
52 Discharge-Side Space
70 Drive Shaft
100 Refrigeration Apparatus
S Cylinder Chamber
S1 First Cylinder Chamber (Cylinder Chamber)
S2 Second Cylinder Chamber (Cylinder Chamber)

The invention claimed is:

1. A rotary compressor comprising:
a cylinder having a cylinder chamber therein;
a piston configured to eccentrically rotate in the cylinder chamber;
a drive shaft configured to drive the piston;
a blade dividing the cylinder chamber into a suction-side space and a discharge-side space;
a cylinder end plate closing an end portion of the cylinder in an axial direction thereof; and
a reed valve having an elongated plate member on the cylinder end plate, wherein
a discharge port communicating with the discharge-side space is formed in the cylinder end plate,
the discharge port being formed such that as viewed in an axial direction of the drive shaft,
part of an opening of the discharge port overlaps with an inside of the cylinder chamber, the elongated plate member of the reed valve closing the opening,
an opening end face of the discharge port is inclined radially outward of the cylinder end plate such that a lowest point of the discharge port is at a radially outermost point thereof, and
in a cross-sectional view orthogonal to a longitudinal direction of the plate member of the reed valve, an upper surface of the plate member is inclined toward a radially outward side of the cylinder end plate.

2. The rotary compressor of claim 1, wherein
a flow path in the discharge port is inclined with respect to the axial direction of the drive shaft such that a first direction from the discharge-side space side toward the opening is directed radially outward of the cylinder end plate.

3. The rotary compressor of claim 2, further comprising:
a cutout formed by cutting out part of an inner peripheral surface of the cylinder, wherein
the cutout forms part of an inner peripheral surface of the flow path.

4. The rotary compressor of claim 1, further comprising:
a reed valve configured to close the opening; and
a fixture member fixing the reed valve to the cylinder end plate, wherein
the fixture member is provided to be inclined at an angle equal to that of the opening end face of the discharge port.

5. The rotary compressor of claim 2, further comprising:
a reed valve configured to close the opening; and
a fixture member fixing the reed valve to the cylinder end plate, wherein
the fixture member is provided to be inclined at an angle equal to that of the opening end face of the discharge port.

6. The rotary compressor of claim 3, further comprising:
a reed valve configured to close the opening; and
a fixture member fixing the reed valve to the cylinder end plate, wherein
the fixture member is provided to be inclined at an angle equal to that of the opening end face of the discharge port.

7. A refrigeration apparatus comprising: the rotary compressor of claim 1.

8. A refrigeration apparatus comprising: the rotary compressor of claim 2.

9. A refrigeration apparatus comprising: the rotary compressor of claim 3.

10. A refrigeration apparatus comprising: the rotary compressor of claim 4.

11. The rotary compressor of claim 1, wherein the opening end face of the discharge port has a circular shape.

* * * * *